US011052523B1

(12) United States Patent
Janson

(10) Patent No.: US 11,052,523 B1
(45) Date of Patent: Jul. 6, 2021

(54) FRAMING HAMMER

(71) Applicant: Paul Janson, Northridge, CA (US)

(72) Inventor: Paul Janson, Northridge, CA (US)

( * ) Notice: Subject to any disclaimer, the term of this patent is extended or adjusted under 35 U.S.C. 154(b) by 0 days.

(21) Appl. No.: 16/726,864

(22) Filed: Dec. 25, 2019

Related U.S. Application Data

(60) Provisional application No. 62/921,374, filed on Jun. 13, 2019.

(51) Int. Cl.
*B25D 1/06* (2006.01)
*B25D 1/14* (2006.01)

(52) U.S. Cl.
CPC ..... *B25D 1/06* (2013.01); *B25D 1/14* (2013.01)

(58) Field of Classification Search
CPC . B25D 1/00; B25D 1/005; B25D 1/04; B25D 1/045
See application file for complete search history.

(56) References Cited

U.S. PATENT DOCUMENTS 2,597,876 A 11/1949 Kurkjian
4,482,132 A 11/1984 Lamansky
5,159,858 A 11/1992 Ganen
5,768,956 A * 6/1998 Coonrad ..... B25D 1/00 254/25
6,923,432 B1 8/2005 Martinez
8,113,488 B2 2/2012 Stewart
D716,628 S 11/2014 West
2003/0052313 A1* 3/2003 Santa Cruz ..... B25C 11/00 254/26 R
2005/0115365 A1* 6/2005 Nau ..... B25D 1/14 81/26
2010/0038609 A1* 2/2010 Chen ..... B25D 1/04 254/26 R
2014/0053342 A1 2/2014 Bronee

OTHER PUBLICATIONS

Jason, Paul, Hammer Picture with Bent Nail, photograph, Dec. 11, 2019, p. 1, Northridge, CA.

* cited by examiner

*Primary Examiner* — Tyrone V Hall, Jr.
(74) *Attorney, Agent, or Firm* — Stan Collier, Esq.

(57) ABSTRACT

The present invention is an improved framing hammer. In one embodiment, the improved framing hammer has two opposing heads. One head being flat and the other head being waffle faced. Each head has a slot running horizontally that is able to hold a nail by a magnet in the slot. The slot further acts as a fulcrum point. On opposite sides of the head, there is a mini-claw and on the other side is a v-slotted extractor mounted to the cheek.

10 Claims, 11 Drawing Sheets

FIG. 1
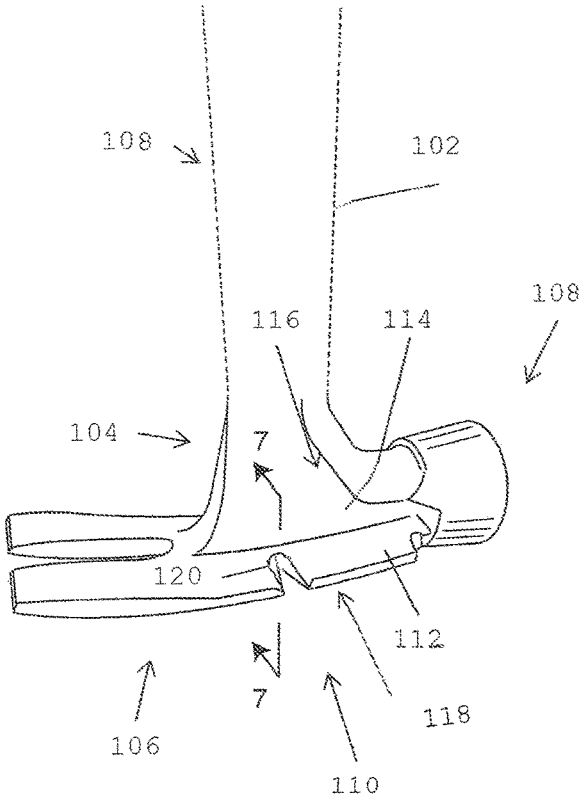
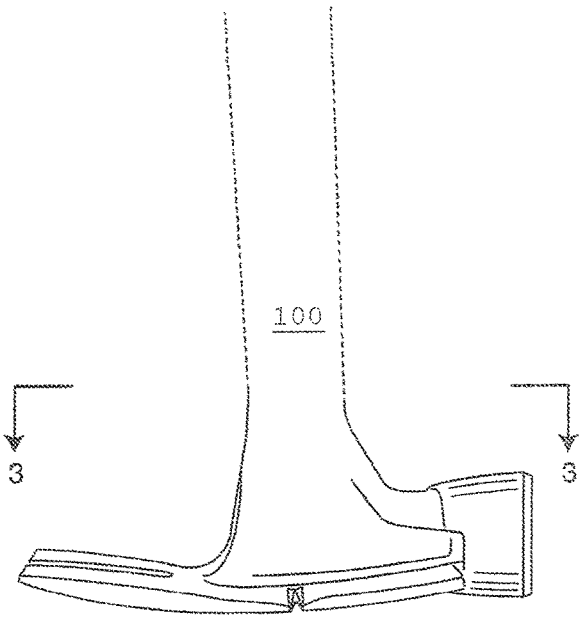
FIG. 2

END VIEW

SIDE VIEW

FRAMING HAMMER

CROSS REFERENCES TO RELATED APPLICATIONS

This utility claims priority to the provisional patent application 62/921,374, filed by the same inventor and filed on Jun. 13, 2019 entitled, "Framing Hammer."

REFERENCE TO FEDERALLY SPONSORED RESEARCH OR DEVELOPMENT

NA

REFERENCE TO JOINT RESEARCH AGREEMENTS

NA

REFERENCE TO SEQUENCE LISTING

NA

BACKGROUND OF THE INVENTION

Field of the Invention

The present invention relates to construction tools, and, more particularly, relates to hammers, and, in greater particularity, relates to framing hammers.

Description of the Prior Art

During construction, nails generally become bent and/or need to be removed as such normal hammers are deficient in this task because the v-notch is too short on existing framing hammers and the nail always slips out when pulling it or it bends and you lose the leverage. To regain leverage, blocks of wood are placed under the hammer, but the best nail puller is a pry bar, but this requires an additional tool at all times. When the v-notch is used to pull the nail sideways, the nail bends into a u-shape about ½ inch around and comes out of the slot, therefore there is a need for an improved nail puller.

Prior art hammers are shown in several patents and patent application, for example: U.S. Pat. No. 4,482,132 shows a hammer with two different V-shaped slots on the head and on the poll of the hammer. U.S. Pat. No. 5,159,858 shows a typical hammer head but with a special side boss having V-shaped slots for pulling nails. U.S. Pat. No. 8,113,488 shows a nail extractor located on the bottom side of the hammer head with the v-slot parallel to the handle. The nails are perpendicular to the side of the head body. 2003/0057407 shows a hammer with a nail removing section between the handle and the poll of the head. 2005/0115365 shows a hammer with two hitting surfaces and a nail pulling is located between the head and the handle. 2014/0053342 shows a framing hammer with two striking surfaces. U.S. Pat. No. D716,628 shows a hammer with an extended platform with a notch thereon. One of the problems with present nail extractors, the nails slip out of the slot/notch because the slot is too short. All references are incorporated by reference.

Accordingly, there is a need for a device and method for allowing nails to be removed easily without the additional assistance of other devices.

SUMMARY OF THE INVENTION

The present invention is an improved framing hammer. In one embodiment, there is one head and on the other end is a conventional claw, and on one side of the hammer, being a cheek, there is at least a v-slotted extractor on the cheek or other forms of extractors such as a mini-claw, a step claw or a slant claw. The sides of the slot may be slanted to better hold different sizes of nails. In another embodiment, the improved framing hammer has two opposing heads. One head being flat and the other head being waffle faced. Each head has a slot running horizontally that is able to hold a nail by a magnet in the slot. The slot further acts as a fulcrum point.

An object of the present invention is to provide a improved framing hammer.

It is another object of the present invention to provide an improved framing hammer with an elongated slot for pulling nails without accidental removal.

It is a further object of the present invention to provide an improved framing hammer having a micro-claw, step claw, and a slant claw.

It is still a further object of the present invention to provide an improved framing hammer with at least two nail extractors to better provide a means to remove nails.

It is yet a further object of the present invention to provide an improved framing hammer having two nail extractors located on opposite sides the head.

It is yet a further object of the present invention to provide an improved framing hammer wherein the extractor force is greater since the pivot point of the extractor is a nail slot or other pivot point at a greater distance.

These and other objects, features, and advantages of the present invention will become more readily apparent from the attached drawings and the detailed description of the preferred embodiments, which follow.

BRIEF DESCRIPTION OF THE DRAWINGS

FIG. 1 illustrates a side perspective view of a hammer having a v-slot on one cheek in a ledge of the present invention, and further showing the direction of cross section in FIG. 7;

FIG. 2 illustrates a side view of FIG. 1 showing the direction of a cross section in FIG. 3;

Like reference numerals refer to like parts throughout the several views of the drawings.

DETAILED DESCRIPTION OF THE PREFERRED EMBODIMENTS

The present invention is an improved framing hammer. In one embodiment, the hammer has a head and opposing that a claw. On one cheek, there is a v-slotted extractor mounted in a ledge along one cheek of the head and claw. Additional types of nail extractors may be used as shown herein. Normal framing hammers are deficient in this task because the v-notch is too short on existing framing hammers and the nail always slips out when pulling it therefore there is a need for an improved nail puller. In another embodiment, the improved framing hammer has two opposing striking means mounted on the hammer head. One striking means being substantially flat and the other striking means being waffle faced. Each striking means has a slot running horizontally that is able to hold a nail by a magnetic in the slot. The slot further acts as a fulcrum point.

The improved framing hammer has a framing length handle with a hand grip mounted on the framing handle proximal end with a head mounted on a distal end of the framing handle. The head comprises at least one striking head mounted on the head with the framing handle thereon. The striking head has a bell mounted on the head in an integral and unitary manner. A neck is mounted on the bell and to the head in an integral and unitary manner. There are two cheeks mounted on the head. A claw may be attached to the head in an integral and unitary manner. The claw is mounted opposite to the striking head. A nail extractor is attached unitarily and integrally to at least the head, and may include a ledge with a slot or mini-claw therein for removably holding a nail integrally and unitarily mounted to the head. The nail extractor may have a mini-claw, a claw slot, a step slot or a slant slot in the ledge. The nail extractors may have slanting sides as well as the step slot and the slant slot. The floor in the slant slot is slanted toward the back side near the cheek so that nails will not slip therefrom easily. The improved framing hammer's slot is between 3/10s of an inch to 1.5 inches long or the slant slot is 3/10s of an inch to 1.5 inches long and have a ledge or flat shelf therein. The ledge may be mounted at an angle from a vertical on said head when held upright. The slots may hold a nail of at least 12 pennies in size.

Figure 3:
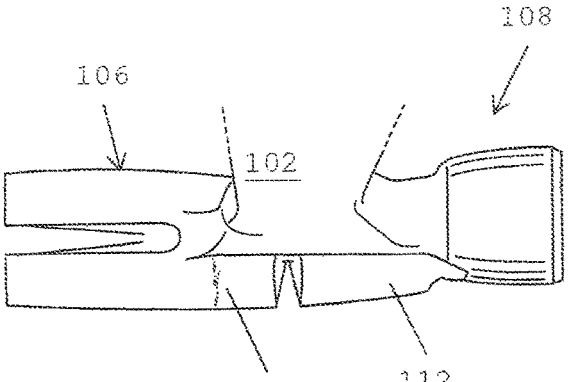
FIG. 3 illustrates a top side perspective view.
Figure 4:
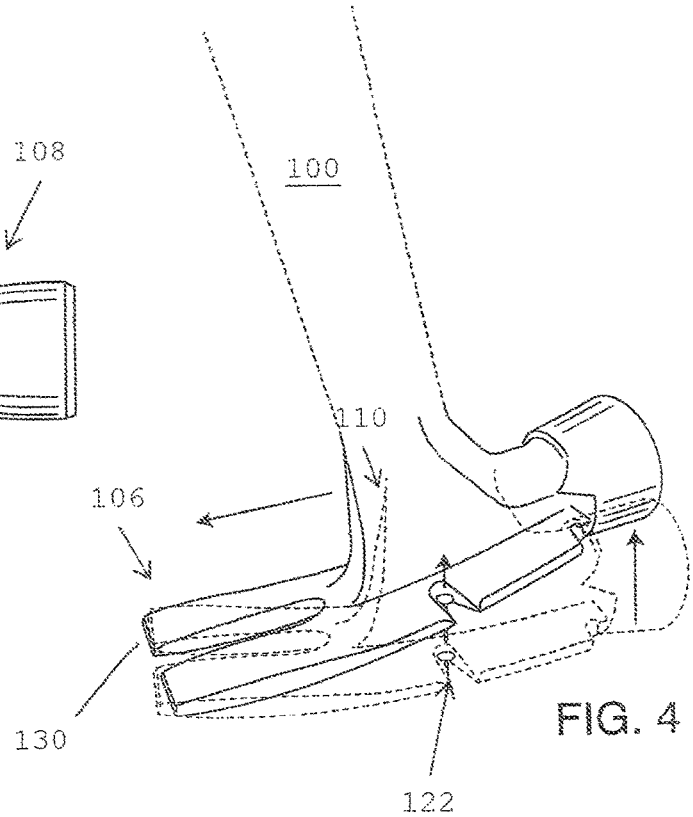
FIG. 4 illustrates a side perspective view with the hammer pulling a nail in the slot and pivoting on the claw.
Figure 5:
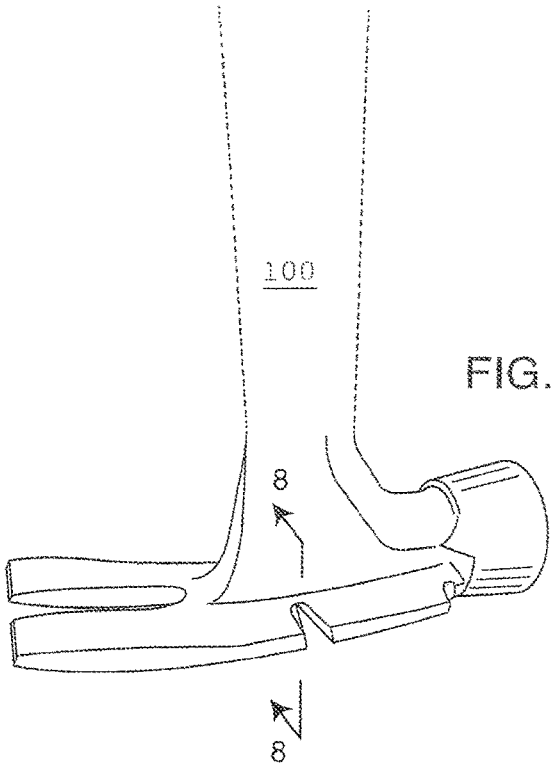
FIG. 5 illustrates a side view as FIG. 1 showing a different section view lines as in FIG. 8.
Figure 6:
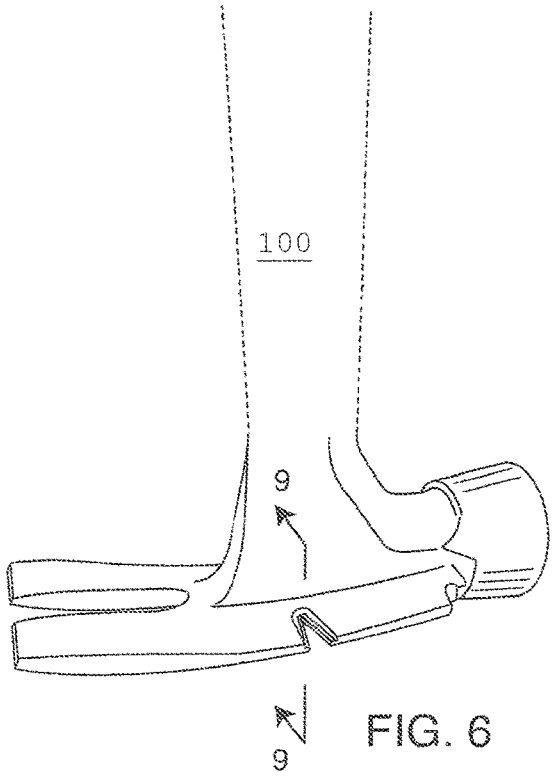
FIG. 6 illustrates a side view as FIG. 1 showing a different section view lines in FIG. 6.
Figure 7:
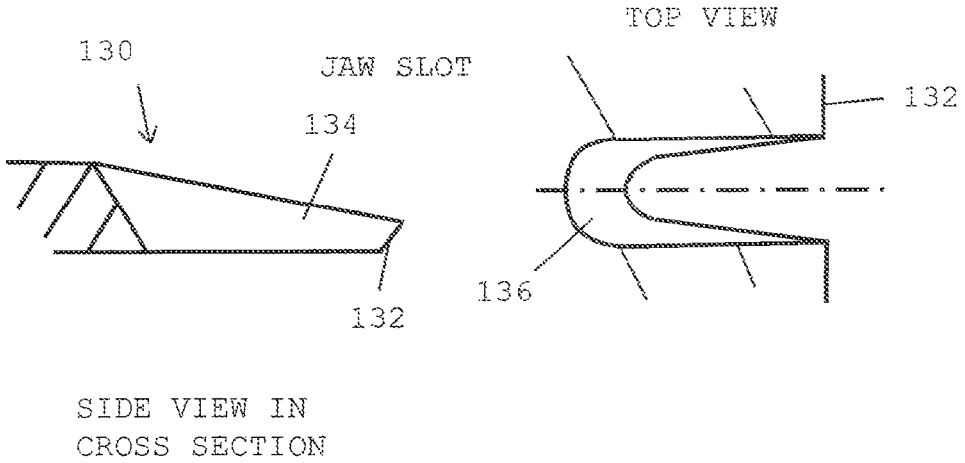
FIG. 7 illustrates the section view of FIG. 1 being a jaw slot of the present invention.
Figure 8:
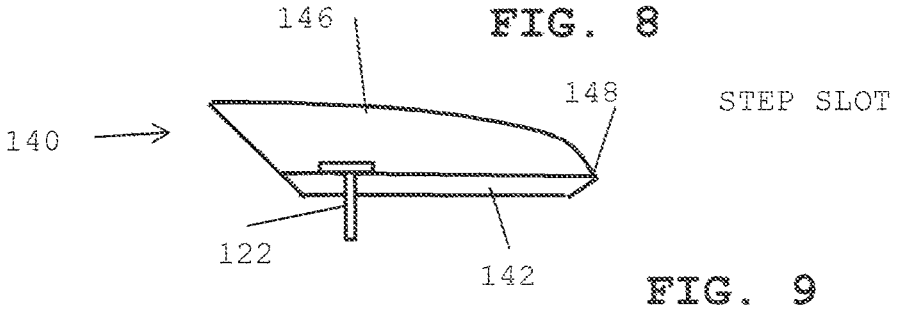
FIG. 8 illustrates the section view of FIG. 5 being a step slot of the present invention.
Figure 9:
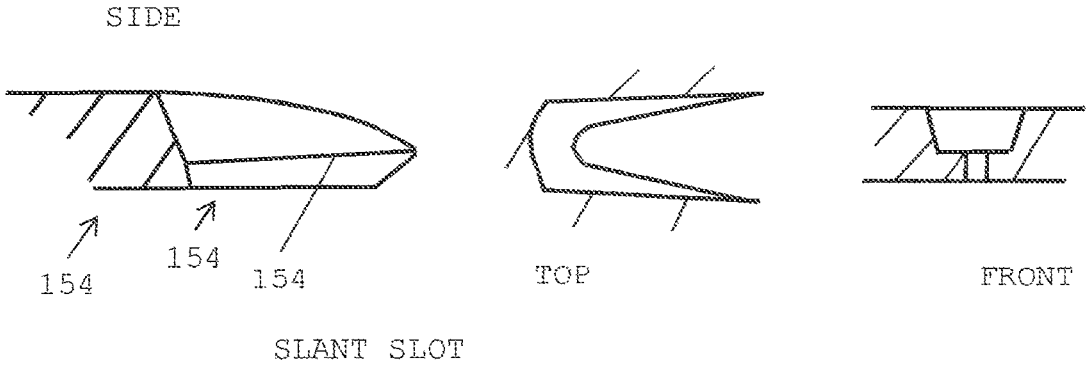
FIG. 9 illustrates the section view of FIG. 6 being the slant slot of the present invention.
Figure 13:
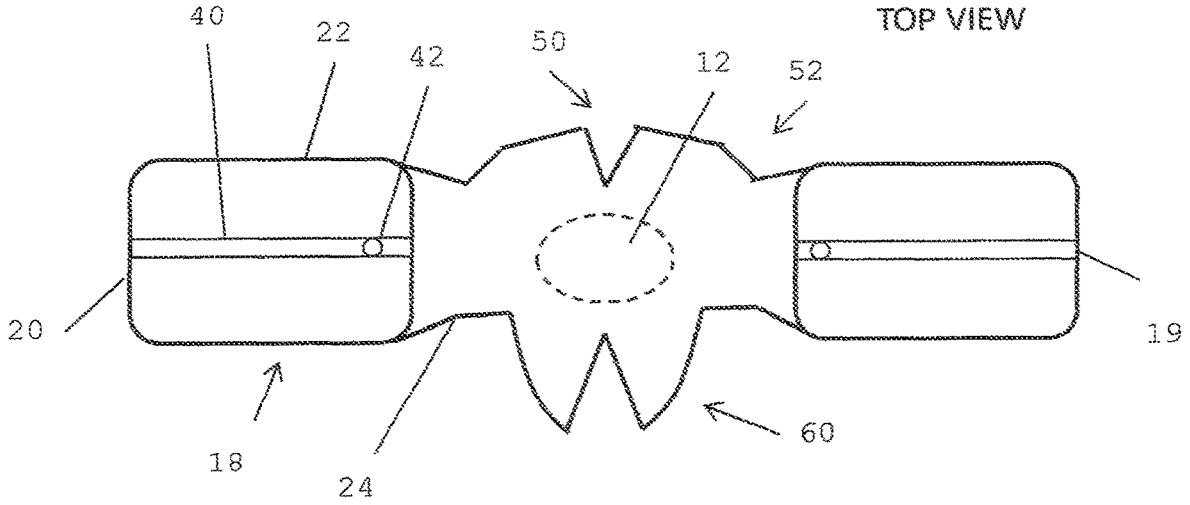
FIG. 13 is a top view of a head of a hammer of the present invention showing two nail extractors located on the checks.

Referring to FIG. 1, an improved framing hammer 100 is shown. An elongated handle 102 is typically merged into a body 104 and head. The body 104 has integrally mounted thereto a claw 106, a striking head 108 and a nail extractor 110. The nail extractor 110 is mounted in a ledge 112 that is mounted to a neck 114, a cheek 116, and to the claw 106. The ledge 112 may be shorter in length. The nail extractor 110 is a v-slot 118 with slanting or ramped sides 120 as seen in FIGS. 2, 3 and 7. The v-slot 118 is between 3/10 of an inch to 1.5 inches in length, from front to back. The nail 122, FIG. 4, with a flat head is allowed to be trapped in the lower section of the slot 118. FIG. 7 shows the v-slot 118 of FIG. 1; FIG. 8 shows the step slot of FIG. 5; FIG. 9 shows the slant slot of FIG. 6. All of the slots may have slanting sides to better hold the nail 122. FIG. 4 shows the hammer 100 pulling a nail 122. The nail 122 has a flat top disk as framing nails conventionally have. Having a longer length in the slot allows different penny sized nails to be pulled. As seen in FIG. 4, the hammer 100 is pulled to the left and pivoting on the ends 130 of the claw 106. Pulling to the right would pivot the hammer 100 on a rounded edge of the striking head 108. Also the hammer 100 could be pushed to the back to pivot on the top end of the main body 104 or on another slot structure thereon. The ledge 112 is approximately 1/8 inch thick and runs from the striking head 108 to an extended claw 106 where the dotted line appears in FIG. 3. The ledge 112 may be shorter depending on the thickness and type of metal used. Typical framing nails are 16 penny framing nails. The ledge 112 may be formed integrally or welded to the hammer cheek. FIG. 7 shows the jaw (v-slot) slot 130 having a pointed front 132 that can be pushed under the nail head initially during removal. The sides 134 are slanted as seen in the top view. The nail head would rest upon the slanted sides/walls 136. The slot length should be greater than 1/3 of an inch up to 1.5 inches to insure that the nail does not fall out accidently. Conventional nail slots bend the nail in a partial U shape due to shortness. FIG. 8 shows a step slot 140 having a level bottom section 142. The walls 146 are also slanted with a sharp front 148. Another slot is shown in FIG. 9 being a slant slot 150 where the bottom section slants downward toward the back so that the nail will not slip out of the slant slot 150 when the hammer is moved around. A mini-claw such as shown in FIG. 13 and others can also be mounted in the ledge. A method of using an improved framing hammer to remove a nail from a wood piece, said method comprising the steps of:

putting a nail in a nail extractor, said nail extractor being a mini-claw, a step slot, a slant slot, or claw slot, said nail extractor being located on a cheek of said hammer or upon a ledge along a cheek;

pushing the hammer to pivot on a striking head, or the hammer head to pull the nail from the wood piece; and removing the nail from the hammer.

Figure 10:
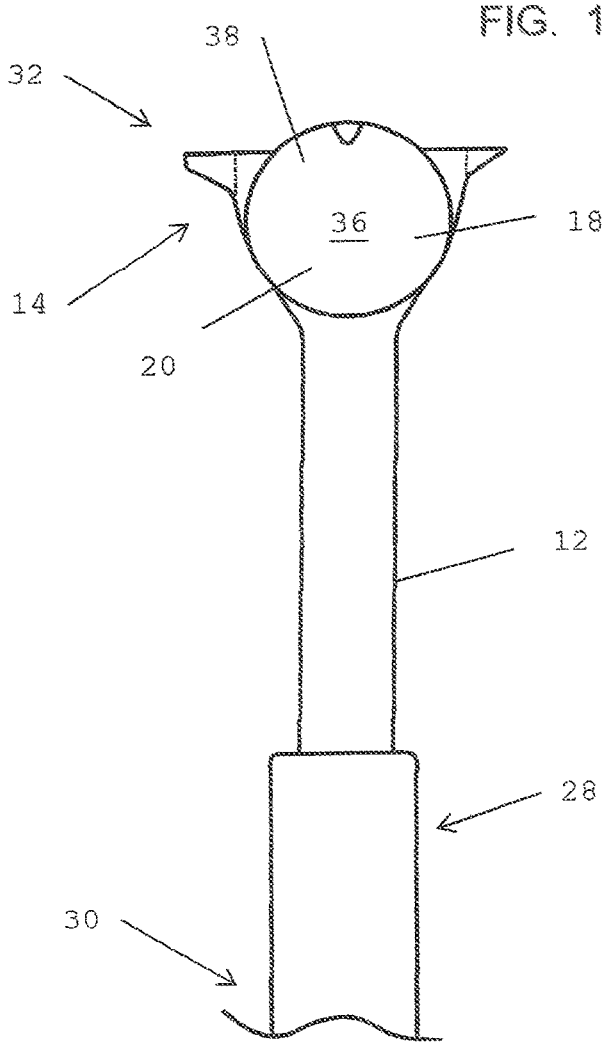
FIG. 10 is an end view of a framing hammer of the present invention showing one head with nail extractors on the checks.

Referring to FIG. 10, another embodiment of an improved framing hammer 10 is shown by end view. Typically the framing hammer 10 has a much longer handle 12 such as 16 inches or so with a heavier head 14 for driving nails 16, FIG. 11. The handle 12 and head 14 are normally formed integrally and unitarily to provide strength. A striking means 18 includes a face 20, a bell 22, a neck 24, and a cheek 26, FIG. 14. The framing handle 12 is approximately 16 inches long and has a hand grip 28 where the hand grip 28 is mounted on the framing handle 12 on a proximal end 30 and made of rubber. There is a head 32 mounted on a distal end 34 of the framing handle 12. On the head 32 there is at least one striking means 36 being mounted on the head 32. The striking means 36 includes a face 38 being mounted on the striking means 36 for hitting objects such as nails 16. The hammer 10 further includes a bell 22, the face 20 mounted on the bell 22 in an integral and unitary manner. The bell 22 has a slot 40 therein for holding nails by a magnet 42. The head includes a neck 24 mounted on the bell 22 in an integral and unitary manner. The head also includes a pair of cheeks 26, only one shown in FIG. 14.

Figure 11:
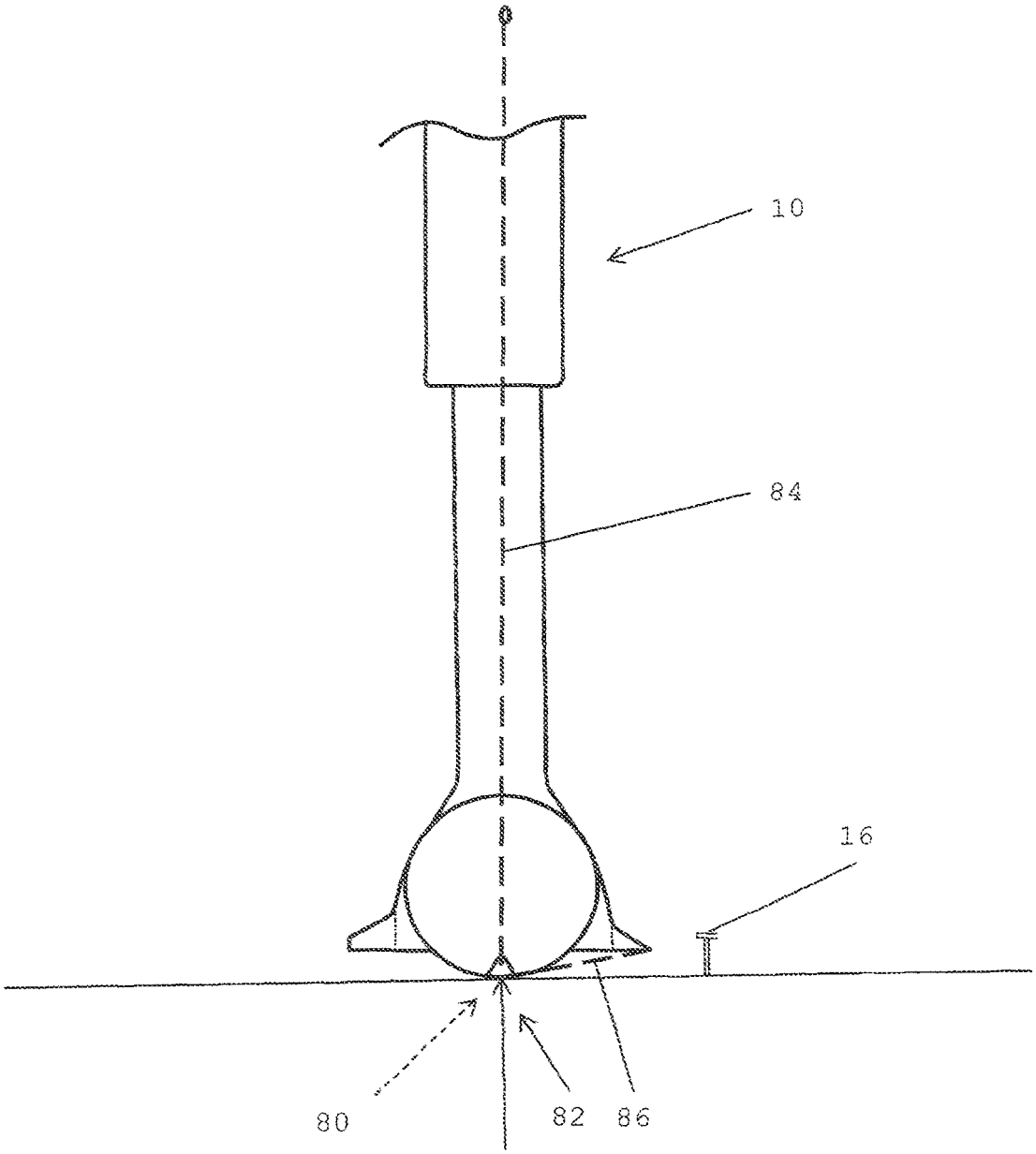
FIG. 11 is diagram showing the torques of the present invention and one fulcrum point.
Figure 14:
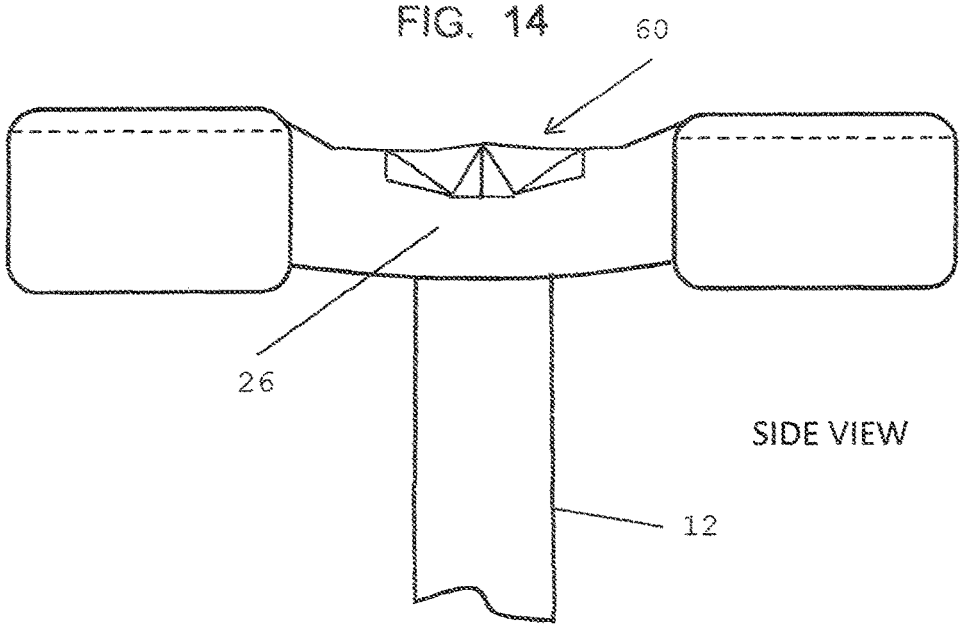
FIG. 14 is a side view of the hammer of FIG. 13 with a mini-claw projecting outward.

A v-notched or slot extractor 50 is mounted on one cheek 52 with the v-notched extractor 50 being mounted perpendicular to the cheek 52 thereon as seen in FIG. 10 and FIG. 11. Also a mini-claw 60, FIGS. 13 and 14, is mounted on the opposite cheek than the v-notched extractor and thus you can have more than one extractor on a hammer.

Figure 12:
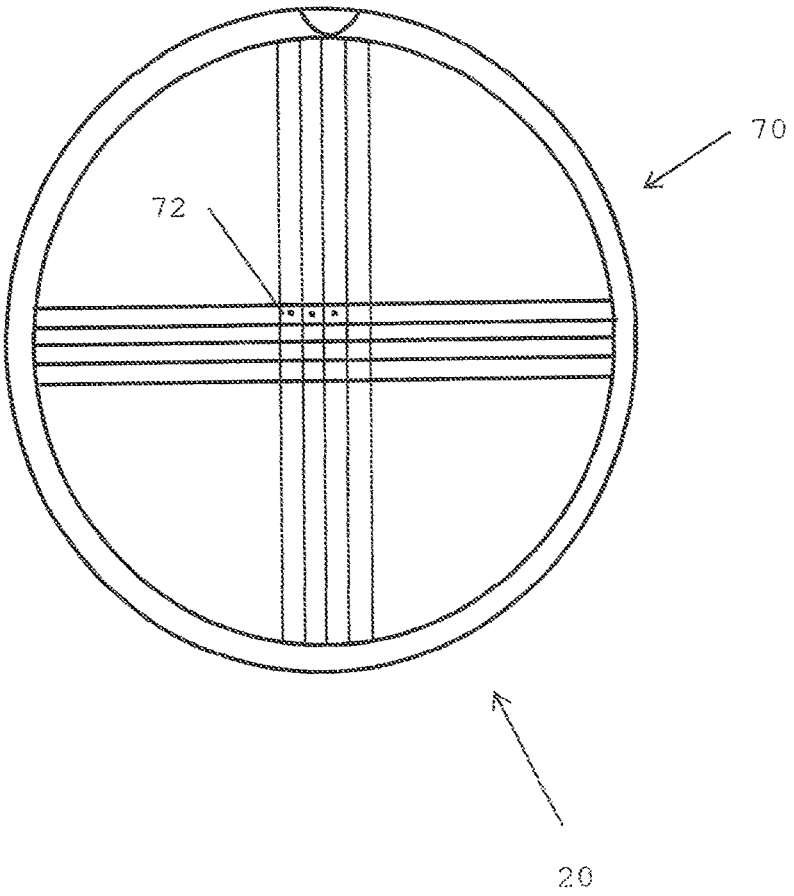
FIG. 12 is an end view of the other hammer head with a partial rough surface shown thereon of the present invention.
Figure 17:
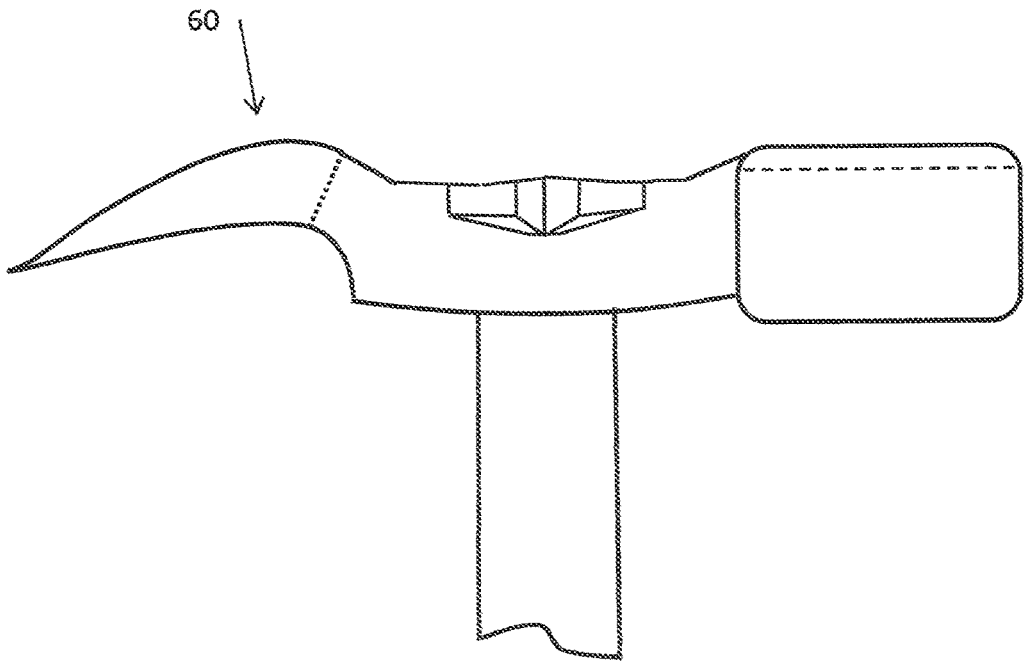
FIG. 17 is a side view of a hammer with a mini-claw for removing nails of the present invention, a ledge may be used to extend the reach of the mini-claw outwards as seen in FIG. 15B.

The improved framing hammer 10 further including a claw 60 or mini-claw 60, FIG. 13, for extracting nails. FIG. 17 is a side view of a claw 60. The improved framing hammer 10 further including a second striking means 19 mounted opposite to the first striking means 20. One striking means 20 has a waffle face 70 with pointed hills 72 thereon to better grip the object being struck as seen in FIG. 12. The other striking means has a smooth face to prevent marring of the object having the nail therein.

Referring to FIG. 11, the improved framing hammer 10 has a slot 80 for nails in said bell act as fulcrum point 82 for either said v-notched extractor or said mini-claw. The distance between said fulcrum and said v-notched extractor and said mini-claw is approximately 1.5 inch to maximize the torque when a force is applied to said handle. FIG. 11 shows a vertical line 84 joining with a shorter leg 86. The shorter the leg 86 more torque is then applied to pull the nail 16.

Figure 15A:
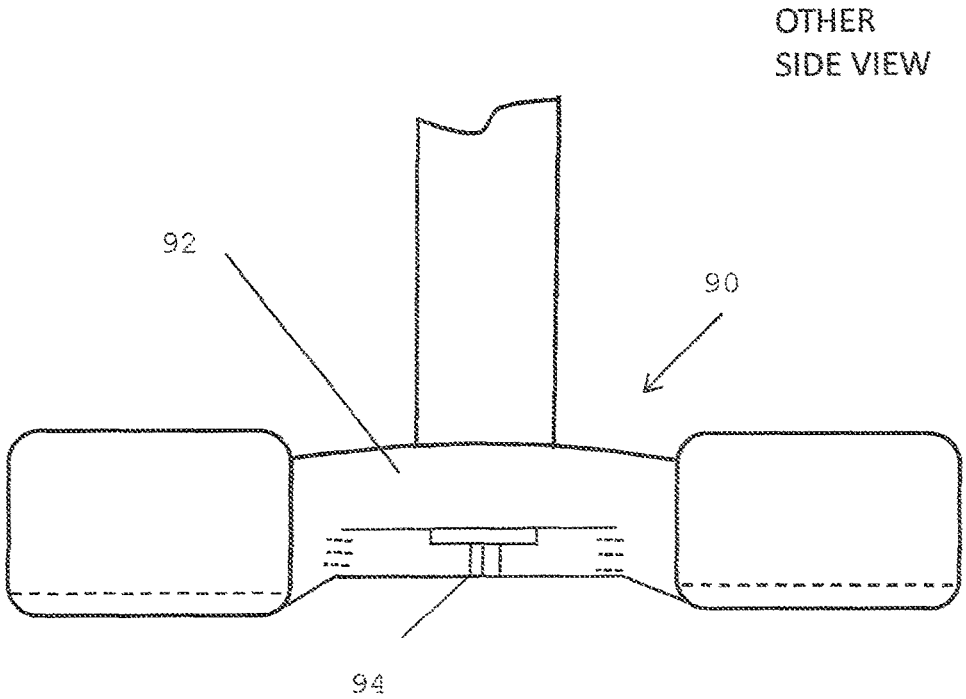
FIG. 15A is a side view of the head showing one embodiment of a V-notched extractor.
Figure 15B:
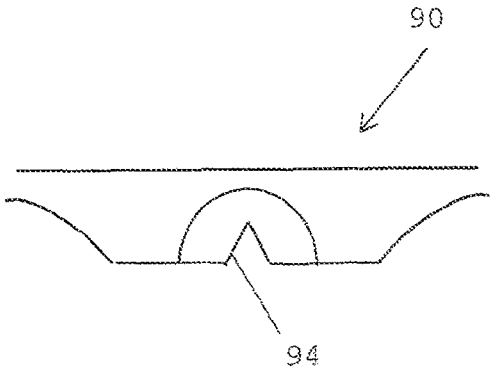
FIG. 15B is a partial top view of the V-notched extractor of one embodiment of the present invention with a notch facing out and placed on a ledge.

The improved framing hammer 10, FIG. 15A, has the v-notched extractor 90 mounted perpendicular to the cheek 92 side. A vertical view of the v-notched extractor 90 is shown in FIG. 15B wherein a step is included about the v-slot to better hold the nail therein. A step v-notch or v-slot 94 is used to remove nails.

Figure 16A:
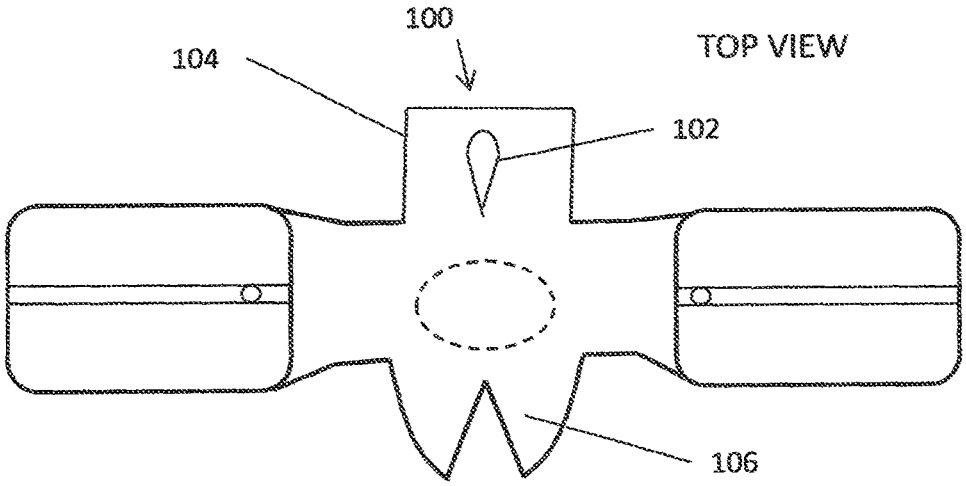
FIG. 16A shows a top view of a hammer with two heads, a mini-claw and a tear drop slot therein on the cheeks.
Figure 16B:
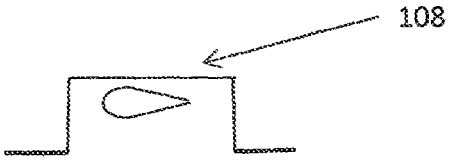
FIG. 16B shows the tear drop slot parallel to the cheek of the hammer.
Figure 16C:
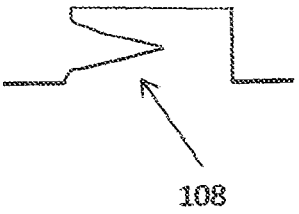
FIG. 16C shows a v-slot running parallel to the cheek of the hammer.

Referring to FIGS. 16A to 16C, a tear dropped extractor 100 extractor is a tear-shaped aperture 102 in a bracket 104 attached to the head either being mounted perpendicular or parallel to the cheeks. The bracket 104 may be the ledge as noted above. Opposite thereto is the mini-claw 106. FIG. 16B shows the tear-shaped aperture parallel to the check and FIG. 16C shows a v-notch 108 mounted parallel to the cheek.

The v-shaped notch is integrally and unitarily mounted either parallel or perpendicular to the cheeks. The framing hammer further including a claw for extracting nails and mounted opposite to the striking head. The hammer may have also a second striking head mounted opposite to a first striking head, one striking head having a waffle face with pointed hills thereon to better grip the object being struck, another striking head having a smooth face to prevent marring of the object being struck.

The nail holding means on said bell acting as fulcrum points for either said v-notched extractor or the mini-claw, a distance between said fulcrum and said v-notched extractor and said mini-claw is approximately 1 inch to maximize the torque when a force is applied to said handle, said one or more slots being locating on the top of said head. The improved framing hammer includes a conventional claw and a v-shaped notch. The mini-claw has a v-notch.

Since many modifications, variations, and changes in detail can be made to the described embodiments of the invention, it is intended that all matters in the foregoing description and shown in the accompanying drawings be interpreted as illustrative and not in a limiting sense. Thus, the scope of the invention should be determined by the appended claims and their legal equivalents.

What is claimed is:

1. An improved framing hammer, said improved framing hammer comprising:

a framing handle, wherein said framing handle is approximately 16 inches long;

a hand grip, said hand grip mounted on said framing handle on a proximal end;

a head, said head mounted on a distal end of said framing handle, said head comprising:

at least one striking head, said striking head being mounted on said head with said framing handle thereon;

a face, said face being mounted on said striking head for hitting objects;

a bell, said face mounted on said bell in an integral and unitary manner;

a neck, said neck mounted on said bell and to said head in an integral and unitary manner;

two cheeks, said cheeks mounted on said head;

a claw attached to said head in an integral and unitary manner, said claw being mounted opposite to said striking head; and a nail extractor attached unitarily and integrally to said head, said cheek, and said claw, said nail extractor having a ledge with at least a slot therein for removably holding a nail, said ledge integrally and unitarily mounted to said head, cheek, and said claw, wherein said slot is between 3/10s of an inch to 1.5 inches long.

2. The improved framing hammer as defined in claim 1, wherein said slot is a claw slot, a step slot or a slant slot or a mini-claw in said ledge.

3. The improved framing hammer as defined in claim 2, wherein said ledge is mounted at an angle from a vertical on said head when held upright.

4. The improved framing hammer as defined in claim 1, wherein said improved framing hammer is capable of using up to at least 12 penny nails wherein said nail is capable of being placed in said slot in said nail extractor.

5. The improved framing hammer as defined in claim 1, wherein said nail extractor is selected from the group consisting of:

a v-notched extractor, said v-notched extractor mounted on one cheek, said v-notched extractor being mounted perpendicular to said cheek thereon, said extractor shaped as a tear-shaped aperture in a bracket attached to said head either being mounted perpendicular or parallel to said cheeks; and a mini-claw, said mini-claw mounted on an opposite cheek than the v-notched extractor.

6. The improved framing hammer as defined in claim 5, herein said mini-claw is mounted perpendicular to said cheek or sideways on said cheek, and said tear drop mounted perpendicular or sideways on said cheek.

7. An improved framing hammer as defined in claim 1, wherein said nail extractor being either a v-notch or a mini-claw.

8. The improved framing hammer as defined in claim 7, wherein a nail holder on said bell acts as a fulcrum point for either said v-notched extractor or a said mini-claw, a distance between said fulcrum and said v-notched extractor and said mini-claw is approximately 1 inch to maximize the torque when a force is applied to said handle, said one or more slots being locating on the top of said head.

9. The improved framing hammer said improved framing hammer comprising:

a framing handle, said handle being approximately 16 inches long;

a hand grip, said hand grip mounted on said framing handle on a lower or proximal end;

a head, said head mounted on a distal end of said framing handle, said head comprising:

at least one striking head, said striking head being mounted on said head;

a face, said face being on said striking head for hitting objects;

a bell, said face mounted on said bell in an integral and unitary manner;

a neck, said neck mounted on said bell in an integral and unitary manner;

two cheeks, said cheeks mounted on said head;

a claw attached to the head in an integral and unitary manner, said claw being mounted opposite to said striking head; and a nail extractor attached unitarily and integrally to said head, said nail extractor being a mini-claw unitarily and integrally mounted to at least one cheek, wherein said mini-claw has a v-notch greater than quarter inch in length.

10. A method of using an improved framing hammer to remove a nail from a wood piece, said method comprising the steps of:

putting a nail in a nail extractor of the improved framing hammer, said nail extractor being a mini-claw, a step slot, a slant slot, or claw slot, said nail extractor being located on a cheek of the improved framing hammer, the improved framing hammer being:

a framing handle;

a hand grip, said hand grip mounted on said framing handle on a proximal end;

a head, said head mounted on a distal end of said framing handle, said head comprising:

at least one striking head, said striking head being mounted on said head with said framing handle thereon;

a face, said face being mounted on said striking head for hitting objects;

a bell, said face mounted on said bell in an integral and unitary manner;

a neck, said neck mounted on said bell and to said head in an integral and unitary manner;

two cheeks, said cheeks mounted on said head;

a claw attached to said head in an integral and unitary manner, said claw being mounted opposite to said striking head; and a nail extractor attached unitarily and integrally to said head, said nail extractor having a ledge with at least a slot therein for removably holding a nail, said ledge integrally and unitarily mounted to said head, wherein said slot is a claw slot, a step slot or a slant slot or a mini-claw in the ledge, wherein said slot is between 3/10s of an inch to 1.5 inches long, and prevents accidental removal of the nail as in prior framing hammers;

pushing or pulling the nail in the mini claw, step slot or slant slot so the hammer pivots on a striking head, or on the claw opposite the striking head to pull the nail from the wood piece; and removing the nail from the hammer.

* * * * *